United States Patent [19]

Otto et al.

[11] 4,332,328

[45] Jun. 1, 1982

[54] MOBILE CRANE

[75] Inventors: Günter Otto, Hilden; Peter Eiler, Düsseldorf, both of Fed. Rep. of Germany

[73] Assignee: Firma Leo Gottwald KG, Duesseldorf-Holthausen, Fed. Rep. of Germany

[21] Appl. No.: 81,330

[22] Filed: Oct. 3, 1979

[30] Foreign Application Priority Data

Oct. 14, 1978 [DE] Fed. Rep. of Germany ..... 2844819

[51] Int. Cl.[3] ..... B66C 23/84; B66C 13/00

[52] U.S. Cl. ..... 212/180; 212/253

[58] Field of Search ..... 414/694; 212/48, 49, 212/66, 67, 68, 69, 179, 180, 181, 253

[56] References Cited

U.S. PATENT DOCUMENTS 2,910,189 10/1959 Scheuerpflug ..... 212/69 X 3,923,407 12/1975 Jensen et al. ..... 212/66 X

FOREIGN PATENT DOCUMENTS 797361 7/1958 United Kingdom ..... 212/69

*Primary Examiner*—Jeffrey V. Nase

*Attorney, Agent, or Firm*—Toren, McGeady & Stanger

[57] ABSTRACT

A mobile crane intended for carrying heavy loads has a slewable upper chassis which is rotatably mounted on a carriage by a conventional rotatable connection and in order to transmit loads greater than the connection can withstand, there is an additional rotary mounting. The additional mounting comprises an inner frame with cantilever arms between the upper chassis and the carriage. The upper chassis is detachably bolted to the arms and the arms have rollers which run in a circular rail fixed to the carriage. The rail has a greater diameter than the width of the carriage to enable it to transmit the heavy loads and moments, but to keep the crane within the statutory width limits for transport by road from site to site, the parts of the circular rail which project beyond the sides of the carriage are detachable. When these parts are detached for transport, the rollers on the cantilevers engage with the remaining parts of the rail at the front and back of the carriage.

15 Claims, 4 Drawing Figures

MOBILE CRANE

Figure 1:
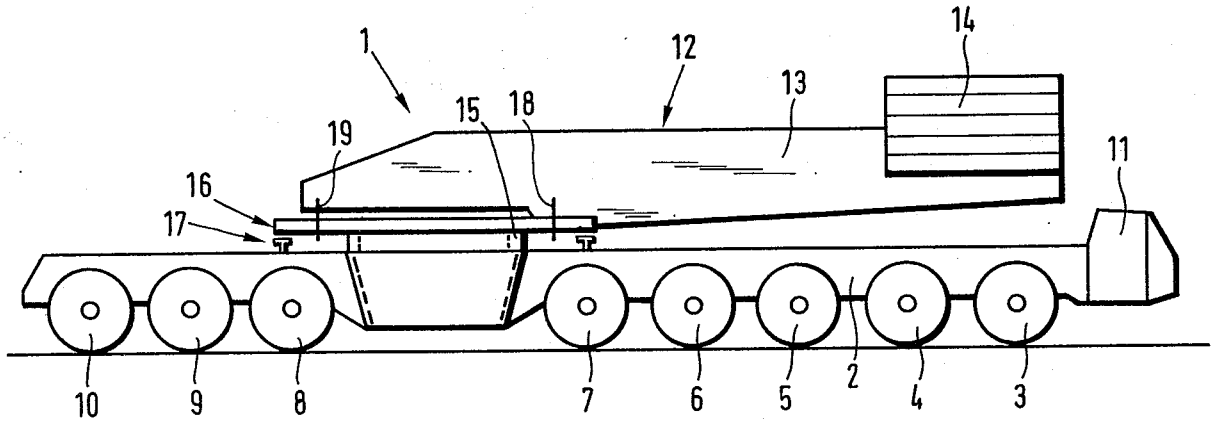

This invention relates to mobile cranes which are particularly intended for carrying heavy loads, and which include a carriage and an upper chassis which is rotatably mounted on the carriage so that it can turn about an upright axis.

With mobile cranes, the problem of how to match practical requirements to legal stipulations is always present. The legal stipulations relating to the transport of cranes has a limiting effect, among other things, on the height, width and length of the crane and also on the maximum permissible axle loading of the crane in the case of wheelmounted cranes which travel from site to site on their own wheels. In the case of cranes for carrying heavy loads, these maximum permissible values can no longer be adhered to. The practice has consequently been introduced of making the superstructure of the crane dismountable from the carriage and then transporting these dismantled parts separately, so that they can be re-assembled again on site. The main parts concerned are the boom of the crane, the counterweight as well as parts which project from the back of the crane upper chassis together with the winding gear and engines.

Even after doing this, the acceptable load carrying capacity cannot be increased at will. When the load carrying capacity of the crane is increased, this is in conflict with the fact that after re-assembly of the crane, both the permissible overall height of the mobile crane may be exceeded and also, or independently of this, the rotary connection between the upper chassis and the carriage becomes overloaded. At the same time, the axle loading increases to a value at which it exceeds the permissible value.

The aim of the present invention is to provide a mobile crane which includes a carriage and an upper carriage rotatably mounted on the chassis and which is constructed in such a way that it is both suitable for carrying heavy loads and can also be transported or driven whilst conforming with legal stipulations.

To this end, according to this invention, in such a crane the upper chassis is connected to the carriage both by a rotary connection and also by additional means which accommodates higher loads, which exceed the maximum load which the rotary connection is constructed to withstand, and distributes such loads to the carriage.

Preferably an intermediate frame is provided for this purpose between the carriage and the upper chassis, the frame being guided in a rotatable manner on the carriage and having the upper chassis detachably fixed to it. This intermediate frame can, in a surprisingly simple manner, fulfill various functions. Firstly, it may provide for the largest possible supporting diameter for the upper chassis whilst adhering to permissible limits, so that the rotary connection can carry the heavy loads. Secondly the complete upper chassis can easily be lifted from the intermediate frame and can then be transported separately. As a result of this, the height of the mobile crane is reduced considerably when it is travelling by road from one site of operations to another to a value which is below the permissible one. The axle loadings are also decreased in a similar way, so that the mobile crane can now comply with permissible limits in every respect. Finally, the intermediate frame provides for excellent distribution of the outer loads on the rotary connection and on the additional guide of the intermediate frame on the carriage.

The intermediate frame may comprise an inner frame from which cantilever arms project outwards and which carry rollers at their ends. The rollers run on a guide on the carriage. In this way it is possible to obtain a high loading on the intermediate frame and consequently a high effective diameter of the rotary connection. It is most advantageous to have the upper chassis fastened to the cantilever arms.

A particularly advantageous construction is obtained if the cantilever arms extend parallel to the longitudinal axis of the upper chassis. This provides for support of the upper chassis and the superstructure which it carries in the same direction as the loads applied to the superstructure. This arrangement has the additional effect of not making it necessary for the intermediate frame to be wider than its inner frame. This is of particular advantage when, in accordance with a further feature of the invention, the inner frame is not wider than the carriage.

According to yet another preferred feature of the invention, the cantilever arms are pivotally connected to the inner frame so that they can tilt about axes which are horizontal and perpendicular to the arms, the arms being held rigid by the fixture of the upper chassis to them. This manner of mounting the cantilever arms makes it easier to ascertain the direction in which the loads are introduced into the carriage so that these loads can be calculated more easily. It is advantageous in this connection to provide for the axes of the cantilever arms to be laterally in alignment with the side portions of the inner frame.

The inner frame advantageously has a circular shape.

Furthermore a circular-shaped rail may be attached to the carriage and then the rollers carried on the intermediate frame run on this rail. The parts of the circular rail which project laterally beyond the carriage are advantageously detachable since with heavy cranes this rail may have an outer diameter of greater than 3 meters and consequently would not comply with the legal width stipulations for travel by road.

The rail may have an open U-section or may be in the form of a double T in section, and in this latter case rollers which are mounted on both sides of the intermediate frame engage with the rail. This construction provides a rotary connection which has good load bearing characteristics, and is suitable for supporting very high loads.

According to another preferred feature of the invention, the diameter of the circular rail is greater than the width of the carriage and the projecting parts, at least in the region where they project the most, can be detached.

This form of the rail makes it possible to increase its diameter so as to exceed the permissible value and in this way to make the rotary connection capable of carrying higher loads. When transport by road or rail is being carried out, the projecting parts are removed so that the mobile crane complies with the permissible width.

The intermediate chassis may be formed of box sections.

Finally, provision may be made for the upper chassis to be mounted on the intermediate frame using screw fastening, i.e. bolts or the like, so that the upper chassis can easily be detached from the intermediate frame.

Figure 2:
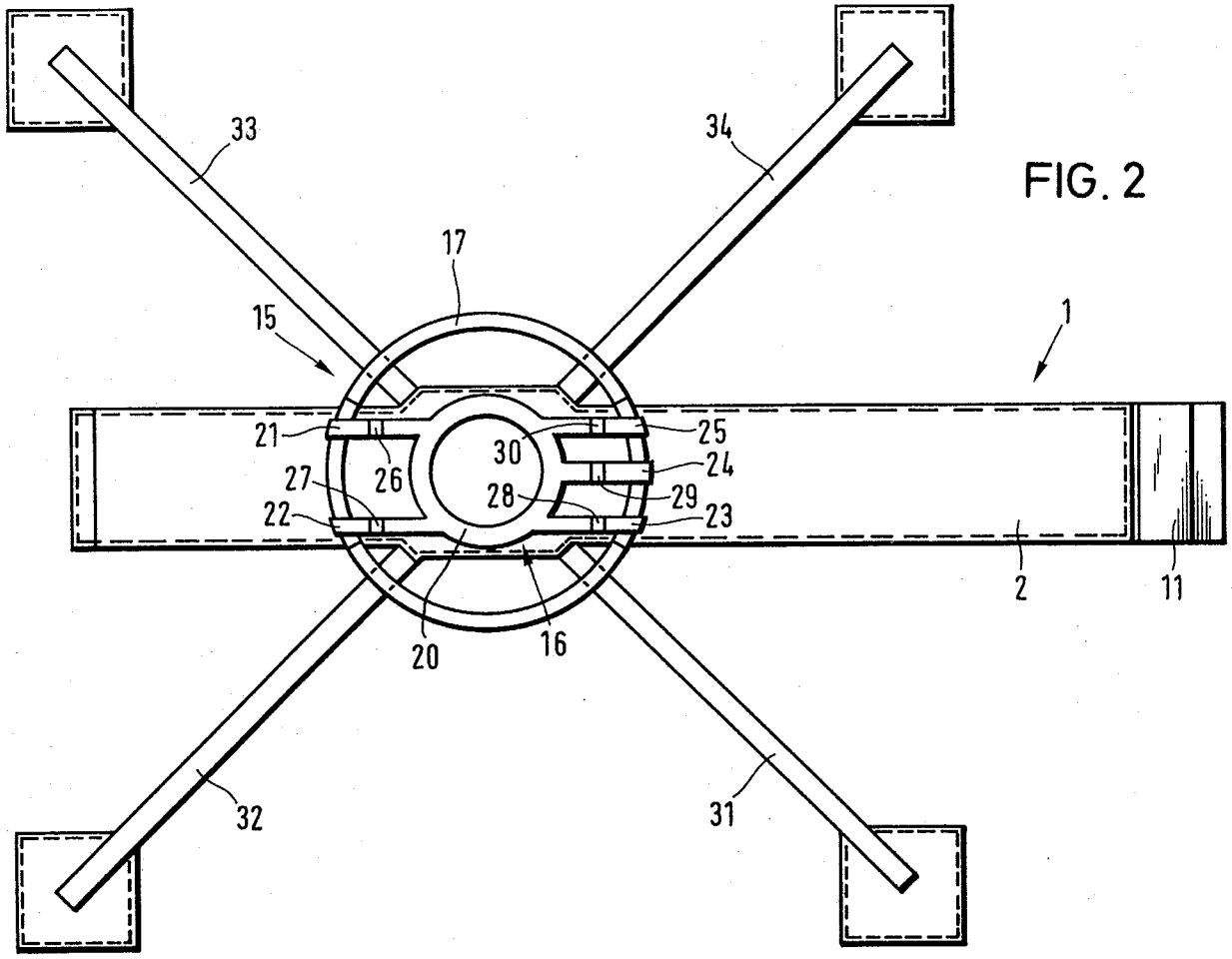
Figure 3:
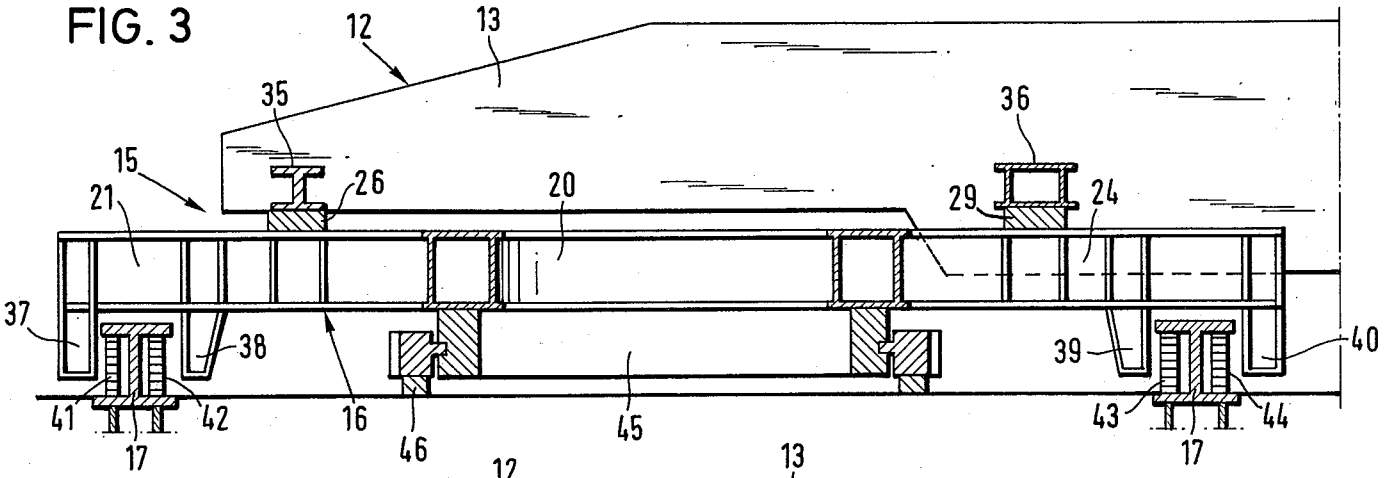
Figure 4:
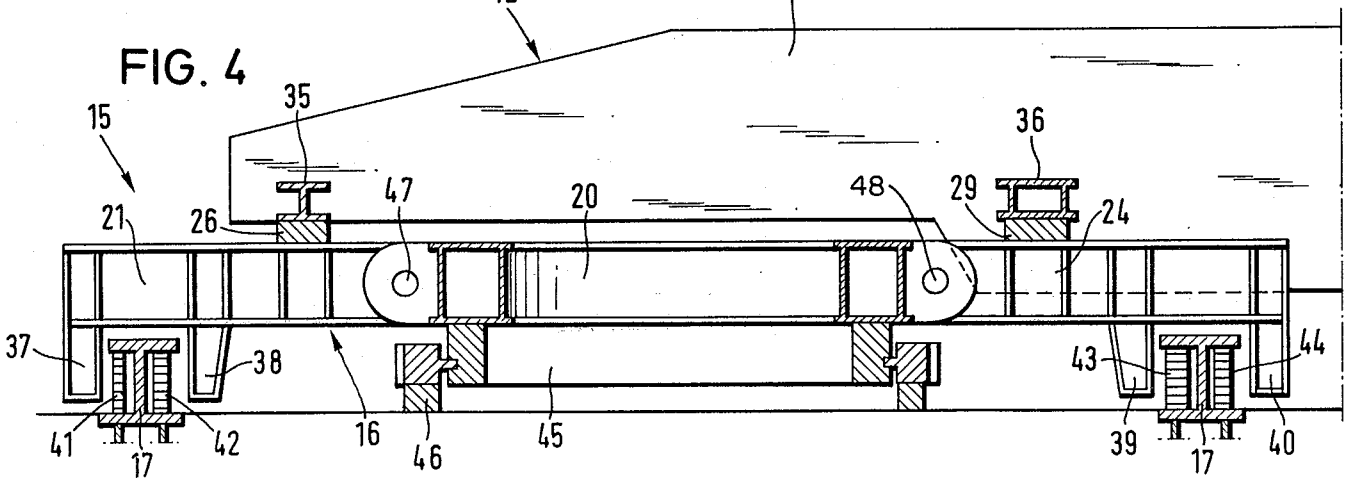

An example together with a modification of a crane in accordance with the invention will now be described with reference to the accompanying drawings in which:

FIG. 1 a side view of the carriage and upper chassis of the crane;

FIG. 2 a plan view of the parts of the crane shown in FIG. 1 with the upper chassis removed;

FIG. 3 a vertical cross-section through the rotary connection between the upper chassis and the carriage of the crane shown in FIGS. 1 and 2; and FIG. 4 a vertical cross-section which is generally similar to FIG. 3 but shows a modification of the intermediate frame.

FIG. 1 shows the carriage and upper chassis of a wheel-mounted mobile crane 1, the illustrated parts forming a motor vehicle. The crane includes lower chassis which is carried by eight axles 3 to 10, together forming a carriage 2. At the right hand end in FIG. 1, a driver's cab 11 is provided on the carriage 2.

A rotary upper chassis 12 is rotatably mounted on the carriage 2. The upper chassis 12 includes a boom 13 which houses engines and winding gear, and has a counterweight 14 provided on its free end. The jib for carrying the load is not shown. The jib is constructed to pivot by means of a lower support on the boom 13 at the end of the boom remote from the counterweight 14. It is also possible to provide a free-hanging counterweight, which is not shown, in order to remove a part of the moment applied to the rotary connection and thus consequently increase the load which can be carried.

A rotary connection 15 between the upper chassis 12 and the carriage 12 is provided with an intermediate frame 16, which runs on an outer ring in the form of a double-T-shaped section circular rail 17 by means of rollers which are shown in more detail in FIGS. 3 and 4. The upper chassis 12 is bolted in a detachable manner to the intermediate frame 16 at fixing points 18 and 19. Consequently, the upper chassis and superstructure 12 can be removed in a simple manner from the carriage in one piece, and then be transported separately, so that the remaining parts of the crane form a vehicle which complies with legal stipulations both as regards its weight and its overall measurements.

FIG. 2 shows the crane vehicle 1 in plan view with the upper chassis 12 removed, so that the construction of the intermediate frame 16 can be seen more clearly. The frame 16 consists of a circular-shaped inner frame 20, the outside diameter of which does not exceed the width of the carriage 2, and the inner 20 has, at the front, three, and, at the back, two cantilever arms 21 to 25 formed on it. These arms extend parallel to each other. This particular construction of the intermediate frame 16 avoids the need for its width to exceed that of the carriage 2 when in the position shown in FIG. 2 which is the position which is used for transport. The cantilever arms 21 to 25 have fastening blocks 26 to 30 attached to them in order that the upper chassis 12 and the superstructure, which are not shown in this Figure, can be attached using bolts.

The free ends of the cantilever arms 21 to 25 are provided with rollers which are not visible in the drawings. The rollers run in the circular rail 17. The circular rail 17 has a relatively large diameter, so that is adequate to bear the very heavy loadings. The portions of the circular rail 17 which project beyond the sides of the carriage can be detached for transport, in order to reduce the overall width of the remaining parts of the crane 1 to the permissible limits.

In operation, when lifting loads, the crane 1 can be supported by means of outriggers 31 to 34.

FIGS. 3 and 4 show partial vertical diametric sections through rotary connection 15 in the longitudinal centre plane of the crane 1 with the upper chassis 12 mounted in position on the intermediate frame 16. The embodiments shown is these Figures only differ from each other insofar as there are connections of different constructions between the cantilever arms 21 to 25 and the inner frame 20. For this reason, the same reference numerals have been used to identify the same parts in the two Figures.

The connection between the upper chassis 12 and the intermediate frame 16 is provided through two members 35, 36, which run perpendicularly to the plane of the drawing of FIGS. 3 and 4. The members 35, 36 are jointed to the upper chassis 12 and span the three cantilever arms 23, 24, 25 and the two cantilever arms 21, 22, and are bolted in a releasable manner to the arms 21 to 25 by means of the fastening blocks 26 to 29.

The ends of the cantilever arms 21 to 25 each have two downwardly projecting pillow blocks 37 to 40, each one of which supports a roller 41 to 44. The rollers 41 to 44 engage in pairs in the spaces at both sides between the upper flange of the circular rail 17 and the lower chassis of the carriage 2. Thus the rollers 41 to 44 are guided in the vertical and horizontal directions in such a way that they are obliged to follow a particular path. The cantilever arms which are not shown in FIGS. 3 and 4 are provided with the same roller arrangement.

A conventional rotary connection is located below the inner frame 20 and this comprises a supporting ring 45, with the side of which a guide ring 46 engages. The ring 46 is fixed to the lower chassis of the carriage 2 of the crane. In addition to guiding functions, the supporting ring 45 takes up and distributes vertical loads and portions of the moments applied to the upper chassis, with a load bearing capacity which corresponds to its designed loading diagram. Loadings which exceed the upper loading limit of the connection 15 are transmitted to the outer ring or rail 17.

In the example of FIG. 3, the connections between the cantilever arms 21, 24 and the inner frame 20 are rigid, that is the two components are welded together. In the modification shown in FIG. 4, the cantilever arms 21, 24 are pivoted on the inner frame 20 by means of pivot connections 47, 48. The arms still form cantilevers however as they are fixed to the upper chassis 12. This embodiment has the advantage that it is easier to establish the manner in which forces are introduced into the lower chassis 2 since the structure as a whole is not so redundant.

We claim:

1. In a mobile crane including a carriage, an upper chassis, means for rotatably supporting said upper chassis on said carriage, said means including rotational connection means for affording rotational movement about a first circle having an upright axis, the improvement comprising that said rotatably supporting means further includes an intermediate frame located between said upper chassis and said carriage and additional means in addition to said rotational connections means for connecting said upper chassis rotatably to said carriage, said additional means being operative to accommodate high loads which exceed the maximum load which said rotational connection means is constructed to withstand, and to distribute said high loads to said carriage, said additional means and said rotational connection means rotatably mounting said intermediate frame on said carriage between said carriage and said upper chassis with said additional means providing for rotational movement about a second circle coaxial with and spaced outwardly from the first circle, said intermediate frame spanning from the first circle to the second circle on opposite sides of the first circle and means detachably fixing said upper chassis to said intermediate frame so that said upper chassis can be removed as a unit from said intermediate frame and carriage.

2. A crane as claimed in claim 1, in which said intermediate frame includes an inner frame, a plurality of cantilever arms projecting outwards from said inner frame and spanning the space between the first circle and second circle, said arms having free ends, said additional means rotatably mounting said intermediate frame on said carriage comprising rollers rotatably mounted on said free ends of said arms and an outer ring located on the second circle and fixed on said carriage, said rollers being in co-operative engagement with said outer ring to transmit loads and moments from said intermediate frame to said outer ring, thence to said carriage.

3. A crane as claimed in claim 2, wherein said means detachably fixing said upper chassis to said intermediate frame connects said upper chassis to said cantilever arms.

4. A crane as claimed in claim 3, wherein said upper chassis has a longitudinal axis extending transversely of the upright axis of the first and second circle and said cantilever arms are all parallel to each other and extend parallel to said longitudinal axis.

5. A crane as claimed in claim 4, in which said inner frame has a width which does not exceed the width of said carriage extending transversely of the longitudinal axis thereof.

6. A crane as claimed in claim 5, further comprising means pivotally connecting said cantilever arms to said inner frame whereby said arms can tilt about axes which are horizontal and perpendicular to said arms, and said means detachably fixing said upper chassis to said arms holding said arms rigid in cantilever relation to said inner frame.

7. A crane as claimed in claim 6, in which a first pair of said plurality of arms are mounted to a first side of said inner frame and a second pair of said plurality of cantilever arms are mounted to an opposite side of said inner frame, the arms of said first pair of arms being in longitudinal alignment with each other and the arms of said second pair of arms being in longitudinal alignment with each other.

8. A crane as claimed in claim 2, in which said inner frame is of circular shape as seen in plan.

9. A crane as claimed in claim 2, in which said outer ring comprises a circular rail and said rollers engage within said rail to guide said rollers both horizontally and vertically.

10. A crane as claimed in claim 9, in which said rail is of horizontal U-shaped cross-section.

11. A crane as claimed in claim 11, in which said rail of U-shaped cross-section is radially outwardly open.

12. A crane as claimed in claim 9, in which said rail is of double-T-shaped cross-section and having an inner side and an outer side and said rollers engage with both said inner side and said outer side of said double-T-shaped cross-section.

13. A crane as claimed in claim 2, in which said outer ring has a diameter which is greater than the width of said carriage and said ring includes portions which project laterally beyond the sides of said carriage, said portions being detachable from the remainder of said ring.

14. A crane as claimed in claim 1, in which said intermediate frame is formed of box sections.

15. A crane as claimed in claim 1, in which said means detachably fixing said upper chassis to said intermediate frame includes screw fastener means.

* * * * *